US010134361B2

(12) United States Patent
Nobori

(10) Patent No.: US 10,134,361 B2
(45) Date of Patent: Nov. 20, 2018

(54) IMAGE PROCESSING DEVICE, PROJECTOR, AND IMAGE PROCESSING METHOD

(71) Applicant: SEIKO EPSON CORPORATION, Tokyo (JP)

(72) Inventor: Tatsuhiko Nobori, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 154 days.

(21) Appl. No.: 14/196,635

(22) Filed: Mar. 4, 2014

(65) Prior Publication Data

US 2014/0253581 A1 Sep. 11, 2014

(30) Foreign Application Priority Data

Mar. 6, 2013 (JP) ..... 2013-043798

(51) Int. Cl.
*G09G 5/02* (2006.01)
*G09G 5/10* (2006.01)

(52) U.S. Cl.
CPC ..... *G09G 5/10* (2013.01); *G09G 2320/0233* (2013.01); *G09G 2320/0646* (2013.01); *G09G 2340/10* (2013.01); *G09G 2360/16* (2013.01)

(58) Field of Classification Search
None
See application file for complete search history.

(56) References Cited

U.S. PATENT DOCUMENTS

2007/0018951 A1 1/2007 Nobori et al.
2007/0025683 A1 2/2007 Nobori
2007/0118812 A1* 5/2007 Kesteloot ..... G11B 27/034 715/800
2007/0273837 A1* 11/2007 Furui ..... G03B 37/00 353/31
2007/0285574 A1 12/2007 Nobori
2008/0036872 A1 2/2008 Nobori
2008/0100554 A1* 5/2008 Mori ..... G09G 3/3406 345/89

(Continued)

FOREIGN PATENT DOCUMENTS

JP 2005-107019 A 4/2005
JP A-2007-41535 2/2007

(Continued)

*Primary Examiner* — Barry Drennan
*Assistant Examiner* — Khoa Vu
(74) *Attorney, Agent, or Firm* — Oliff PLC

(57) ABSTRACT

An image processing device includes a first extension ratio calculation section adapted to calculate a first extension ratio based on a grayscale value included in first image data, a second extension ratio calculation section adapted to calculate a second extension ratio based on a grayscale value included in second image data, a first extension section adapted to correct the grayscale value included in the first image data based on the first extension ratio, a second extension section adapted to correct the grayscale value included in the second image data based on selected one of the first extension ratio and the second extension ratio, and a combination section adapted to generate composite image data obtained by combining the first image data having the grayscale value corrected by the first extension section and the second image data having the grayscale value corrected by the second extension section with each other.

12 Claims, 7 Drawing Sheets

(56) References Cited

U.S. PATENT DOCUMENTS

| | | | | |
|---|---|---|---|---|
| 2008/0136755 | A1* | 6/2008 | Chuang | G09G 5/005 345/87 |
| 2009/0244086 | A1* | 10/2009 | Miyasaka | H04N 13/0438 345/589 |
| 2009/0284544 | A1 | 11/2009 | Nobori | |
| 2010/0002104 | A1* | 1/2010 | On | G06T 5/007 348/252 |
| 2011/0090262 | A1* | 4/2011 | Kim | G09G 3/3406 345/690 |
| 2011/0150356 | A1* | 6/2011 | Jo | G06T 5/002 382/269 |
| 2012/0019524 | A1 | 1/2012 | Nobori | |
| 2012/0019568 | A1 | 1/2012 | Nobori | |
| 2013/0044146 | A1* | 2/2013 | Kurokawa | G09G 3/3406 345/690 |
| 2013/0050291 | A1 | 2/2013 | Nobori et al. | |
| 2013/0088693 | A1 | 4/2013 | Terashima et al. | |
| 2013/0100349 | A1* | 4/2013 | Look | H04N 5/44 348/558 |
| 2014/0078167 | A1 | 3/2014 | Nobori | |
| 2015/0009249 | A1* | 1/2015 | Kudo | G09G 3/36 345/691 |

FOREIGN PATENT DOCUMENTS

| | | |
|---|---|---|
| JP | A-2008-225026 | 9/2008 |
| JP | B2-4210863 | 1/2009 |
| JP | 2009-192804 A | 8/2009 |
| JP | B2-4432933 | 3/2010 |
| JP | A-2010-204520 | 9/2010 |
| JP | A-2010-210722 | 9/2010 |
| JP | A-2010-211091 | 9/2010 |
| JP | B2-4591724 | 12/2010 |
| JP | B2-4687515 | 5/2011 |
| JP | B2-4687526 | 5/2011 |
| JP | B2-4862354 | 1/2012 |
| JP | A-2012-028963 | 2/2012 |
| JP | A-2012-028964 | 2/2012 |
| JP | A-2012-028965 | 2/2012 |
| JP | B2-4956932 | 6/2012 |
| JP | B2-4962722 | 6/2012 |
| JP | B2-4967637 | 7/2012 |
| JP | A-2013-050523 | 3/2013 |
| JP | A-2013-83714 | 5/2013 |
| JP | A-2014-48527 | 3/2014 |
| JP | A-2014-59530 | 4/2014 |

* cited by examiner

IMAGE PROCESSING DEVICE, PROJECTOR, AND IMAGE PROCESSING METHOD

The entire disclosure of Japanese Patent Application No. 2013-043798, filed Mar. 6, 2013, is expressly incorporated by reference herein.

BACKGROUND

1. Technical Field

The present invention relates to an image processing device, a projector, and an image processing method.

2. Related Art

In the field of image processing devices, there has been known a technology of extending the range of the distribution of the luminance of image data to thereby improve the contrast of the image. In JP-A-2007-41535 (Document 1), there is described the fact that in calculating the extension coefficient for extending the range of the luminance distribution, the extension coefficient is calculated using the maximum value and an average value of the luminance of pixels included in a small area in the central, area of the image in order to reduce an influence of a black bar for subtitles or black bars corresponding to the aspect ratio. In JP-A-2008-225026 (Document 2), there is described the fact that in the case of extending a video signal on which an OSD (On Screen Display) signal is superimposed, the luminance of the OSD signal is previously set to a value smaller than the maximum value of the luminance of the video signal to thereby suppress degradation of the image quality of the OSD.

In the case in which the OSD is displayed while being superimposed on the image (hereinafter referred to as a "main image") corresponding to the video signal, it is not necessarily desirable for the OSD to be displayed in the central area of the main image. For example, in the case in which important information displayed by the main image exists in the central area of the main image, the OSD is displayed in an area other than the central area of the main image in some cases. In this case, in the technology described in Document 1, since the luminance of the OSD signal is not considered in calculating the extension coefficient, there is a possibility of causing the highlight detail loss in which most of the pixels included in the OSD are whitened. Further, in the technology described in Document 2, there is a problem that there occurs a restriction in designing the OSD.

SUMMARY

An advantage of some aspects of the invention is to extend the range of the distribution of the luminance of a second image data at an extension rate suitable for the second image data to thereby suppress the degradation of the image quality of the second image data.

An aspect of the invention provides an image processing device including a first extension ratio calculation section adapted to calculate a first extension ratio based on a grayscale value included in first image data, a second extension ratio calculation section adapted to calculate a second extension ratio based on a grayscale value included in second image data, a first extension section adapted to correct the grayscale value included in the first image data based on the first extension ratio to extend a range of a distribution of luminance of the first image data, a second extension section adapted to correct the grayscale value included in the second image data based on selected one of the first extension ratio and the second extension ratio to extend a range of a distribution of luminance of the second image data, and a combination section adapted to generate composite image data obtained by combining the first image data having the grayscale value corrected by the first extension section and the second image data having the grayscale value corrected by the second extension section with each other. According to the image processing device of this aspect of the invention, the range of the distribution of the luminance of the second image data is extended at an extension ratio more suitable for the second image data compared to the case in which the extension of the range of the distribution of the luminance of the first image data and the extension of the range of the distribution of the luminance of the second image data are not performed individually.

In another preferred aspect of the invention, the second extension section extends the range of the distribution of the luminance of the second image data based on the second extension ratio in a case in which the first extension ratio is higher than the second extension ratio. According to the image processing device of this aspect of the invention, the range of the distribution of the luminance of the second image data is prevented from being excessively extended compared to the case in which the range of the distribution of the luminance of the second image data is extended based on the first extension ratio.

In another preferred aspect of the invention, the second extension section extends the range of the distribution of the luminance of the second image data based on the first extension ratio in a case in which the first extension ratio is one of equal to or lower than the second extension ratio. According to the image processing device of this aspect of the invention, in the case in which the first extension ratio is equal to or lower than the second extension ratio, the range of the distribution of the luminance of the second image data is extended at the extension ratio at which the range of the distribution of the luminance of the first image data is extended.

In another preferred aspect of the invention, the image processing device further includes a dimming section adapted to dim a light source, a dimming ratio calculation section adapted to calculate a dimming ratio based on selected one of the first extension ratio and the second extension ratio, and a drive section adapted to drive the dimming section based on the dimming ratio. According to the image processing device of this aspect of the invention, the dimming ratio is calculated without directly using the grayscale value.

In another preferred aspect of the invention, the dimming ratio calculation section calculates the dimming ratio based on the second extension ratio in a case in which a maximum value of the luminance calculated from the grayscale value included in the first image data is one of equal to or lower than a threshold value. According to the image processing device of this aspect of the invention, in the case in which the maximum value of the luminance is equal to or lower than the threshold value, the image represented by the second image data is prevented from becoming darker compared to the case in which the dimming ratio is calculated based on the first extension ratio.

In another preferred aspect of the invention, the dimming ratio calculation section calculates the dimming ratio based on the first extension ratio in a case in which a maximum value of the luminance calculated from the grayscale value included in the first image data is higher than a threshold value. According to the image processing device of this aspect of the invention, in the case in which the maximum value of the luminance is higher than the threshold value, the light source is dimmed in accordance with the grayscale value included in the first image data.

In another preferred aspect of the invention, the image processing device further includes a dimming section adapted to dim a fight source, a dimming ratio calculation section adapted to calculate a dimming ratio based on the first extension ratio, and a drive section adapted to drive the dimming section based on the dimming ratio. According to the image processing device of this aspect of the invention, the light source is dimmed at the dimming ratio more suitable for the grayscale value of the first image data compared to the case in which the dimming ratio is calculated based on the second extension ratio.

In another preferred aspect of the invention, the first extension ratio calculation section calculates the first extension ratio based on a maximum value and an average value of the luminance calculated from the grayscale value included in the first image data, and the second extension ratio calculation section calculates the second extension ratio based on a maximum value and an average value of the luminance calculated from the grayscale value included in the second image data. According to the image processing device of this aspect of the invention, the range of the distribution of the luminance of each of the first image data and the second image data is extended in accordance with the maximum value and the average value of the luminance.

Another aspect of the invention provides a projector including a first extension ratio calculation section adapted to calculate a first extension ratio based on a grayscale value included in first image data, a second extension ratio calculation section adapted to calculate a second extension ratio based on a grayscale value included in second image data, a first extension section adapted to correct the grayscale value included in the first image data based on the first extension ratio to extend a range of a distribution of luminance of the first image data, a second extension section adapted to correct the grayscale value included in the second image data based on selected one of the first extension ratio and the second extension ratio to extend a range of a distribution of luminance of the second image data, a combination section adapted to generate composite image data obtained by combining the first image data having the grayscale value corrected by the first extension section and the second image data having the grayscale value corrected by the second extension section with each other, and a light modulation section adapted to modulate incident light based on the composite image data. According to the projector of this aspect of the invention, the range of the distribution of the luminance of the second image data is extended at an extension ratio more suitable for the second image data compared to the case in which the extension of the range of the distribution of the luminance of the first image data and the extension of the range of the distribution of the luminance of the second image data are not performed individually.

Still another aspect of the invention provides an image processing method including calculating a first extension ratio based on a grayscale value included in first image data, calculating a second extension ratio based on a grayscale value included in second image data, correcting the grayscale value included in the first image data based on the first extension ratio to extend a range of a distribution of luminance of the first image data, correcting the grayscale value included in the second image data based on selected one of the first extension ratio and the second extension ratio to extend a range of a distribution of luminance of the second image data, and generating composite image data obtained by combining the first image data having the grayscale value corrected by the first extension section and the second image data having the grayscale value corrected by the second extension section with each other. According to the image processing method of this aspect of the invention, the range of the distribution of the luminance of the second image data is extended at an extension ratio more suitable for the second image data compared to the case in which the extension of the range of the distribution of the luminance of the first image data and the extension of the range of the distribution of the luminance of the second image data are not performed individually.

BRIEF DESCRIPTION OF THE DRAWINGS

The invention will be described with reference to the accompanying drawings, wherein like numbers reference like elements.

DESCRIPTION OF AN EXEMPLARY EMBODIMENT

Figure 1:
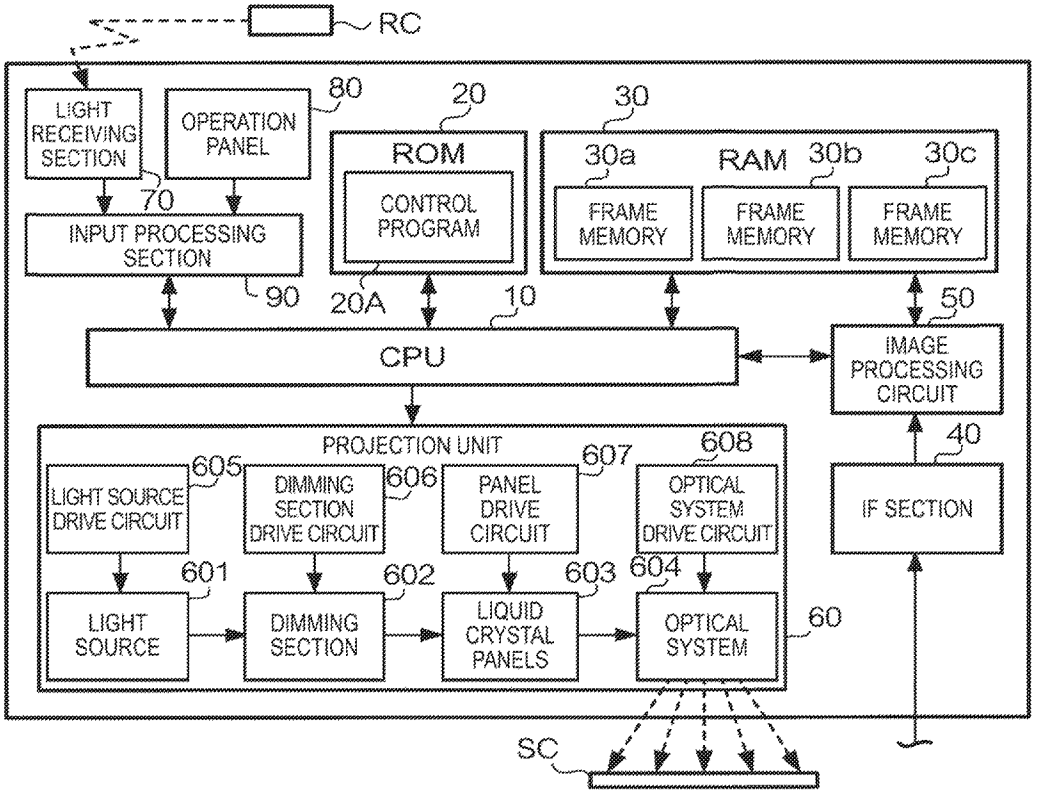
FIG. 1 is a block diagram showing an internal configuration of a projector.

FIG. 1 is a block diagram showing an internal configuration of a projector 1 according to an embodiment of the invention. The projector 1 is a device for protecting a main image on a screen SC. The projector 1 also displays an OSD (On Screen Display) so as to be superimposed on the main image. The projector 1 has a function of controlling a variety of parameters related to the brightness, the position, zooming, the distortion correction, and so on of an image to be projected on the screen SC. The OSD functions as a user interface used for controlling these parameters. The controller RC is a device for controlling the projector 1 using wireless communication such as infrared communication, a so-called remote controller. The user operates the controller RC while looking at the OSD projected on the screen SC to control the variety of parameters. The screen SC is a plane reflecting an image projected from the projector 1.

The projector 1 includes a central processing unit (CPU) 20, a read only memory (ROM) 20, a random access memory (RAM) 30, an interface (IF) section 40, an image processing circuit 50, a projection unit 60, a light receiving section 70, an operation panel 80, and an input processing section 90. The CPU 10 is a control device which executes a control program 20A to thereby control the sections of the projector 1. The ROM 20 is a nonvolatile storage device storing a variety of programs and data. The ROM 20 stores the control program 20A executed by the CPU 10, and image data (hereinafter referred to as "OSD data") representing the OSD. The RAM 30 is a volatile storage device for storing data. The RAM 30 includes a frame memory 30*a*, a frame memory 30*b*, and a frame memory 30*c*. The frame memory 30*a* is an area for storing an image corresponding to one frame of a video image represented by the video signal. The frame memory 30*b* is an area for storing the OSD data to be displayed. The frame memory 30*c* is an area for storing composite image data obtained by superimposing the OSD on the main image. The IF section 40 obtains the video signal from an external device such as a DVD (Digital Versatile Disc) player or a personal computer.

The IF section 40 is provided with a variety of types of terminals (e.g., a USB (Universal Serial Bus) terminal, a LAN (Local Area Network) terminal, an S terminal, an RCA terminal, a D-sub (D-subminiature) terminal, and an HDMI (High-Definition Multimedia Interface; a registered trademark) terminal) for connecting to the external device. The IF section 40 extracts vertical and horizontal sync signals from the video signal thus obtained. The image processing circuit 50 performs the image processing on the image represented by the video signal. The image processing circuit 50 writes the image data representing the image, on which the image processing has been performed, in the frame memory 30*a* as the main image data by one frame.

The projection unit 60 includes a light source 601, a dimming section 602, liquid crystal panels 603, an optical system 604, a light source drive circuit 605, a dimming section drive circuit 606, a panel drive circuit 607, and an optical system drive circuit 608. The light source 601 has a lamp such as a high-pressure mercury lamp, a halogen lamp, or a metal halide lamp, or one of other light emitting bodies, and irradiates the liquid crystal panels 603 with light.

Figure 2:
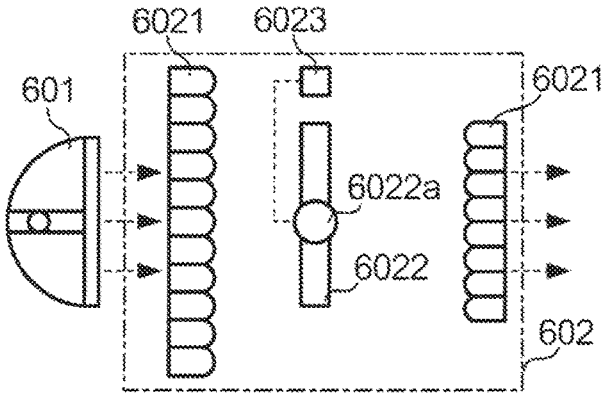
FIG. 2 is a diagram mainly showing a configuration of a dimming section.

FIG. 2 is a diagram mainly showing a configuration of the dimming section 602. The dimming section 602 dims the light source 601. The dimming section 602 includes a pair of fly-eye lenses 6021, a light blocking plate 6022, and a stepping motor 6023. The fly-eye lenses 6021 are each a lens for homogenizing the light applied by the light source 601. The light blocking plate 6022 blocks the light applied by the light source 601. In FIG. 2, the light blocking plate 6022 is disposed, for example, between the pair of fly-eye lenses 6021. The light blocking plate 6022 has a rotary shaft 6022*a*. The stepping motor 6023 rotates the light blocking plate 6022 to control the light intensity in accordance with the rotational angle of the light blocking plate 6022. The stepping motor 6023 rotates the light blocking plate 6022 around the rotary shaft 6022*a*.

FIG. 1 is referred to again. The liquid crystal panels 603 are each a light modulation device for modulating the light dimmed by the dimming section 602 in accordance with the image data. In the present example, each of the liquid crystal panels 603 has a plurality of pixels arranged in a matrix. Each of the liquid crystal panels 603 has the resolution of, for example, XGA (eXtended Graphics Array), and has a display area composed of 1024×768 pixels. In this example, the liquid crystal panels 603 are each a transmissive liquid crystal panel, and the transmittance of each of the pixels is controlled in accordance with the image data. The projector 1 has three liquid crystal panels 603 corresponding respectively to the three primary colors of RGB. The light from the light source 601 is separated into colored lights of three colors of RGB, and the colored lights respectively enter the corresponding liquid crystal panels 603. The colored lights, which have been modulated while passing through the respective liquid crystal panels 603, are combined by a cross dichroic prism or the like, and the combined light is then emitted to the optical system 604. The optical system 604 includes a lens for enlarging the light modulated by the liquid crystal panels 603 into the image light and then projecting the light on the screen SC, a zoom lens for performing expansion/contraction of the image to be projected, and the focus adjustment, a zoom controlling motor for controlling a zoom level, a focus adjusting motor for performing the focus adjustment, and so on. The light source drive circuit 605 drives the light source 601 with the control by the CPU 10. The dimming section drive circuit 606 (an example of a drive section) drives the stepping motor 6023 of the dimming section 602 with the control by the CPU 10. The panel drive circuit 607 drives the liquid crystal panels 603 in accordance with the image data output from the CPU 10. The optical system drive circuit 608 drives the motors included in the optical system 604 with the control by the CPU 10.

The light receiving section 70 receives an infrared signal transmitted from the controller RC, decodes the infrared signal thus received, and then outputs the result to the input processing section 90. The operation panel 80 has buttons and switches for performing ON/OFF of the power and a variety of operations of the projector 1. The input processing section 90 generates the information representing the content of the operation by the controller RC or the operation panel 80, and then outputs the information to the CPU 10.

Figure 3:
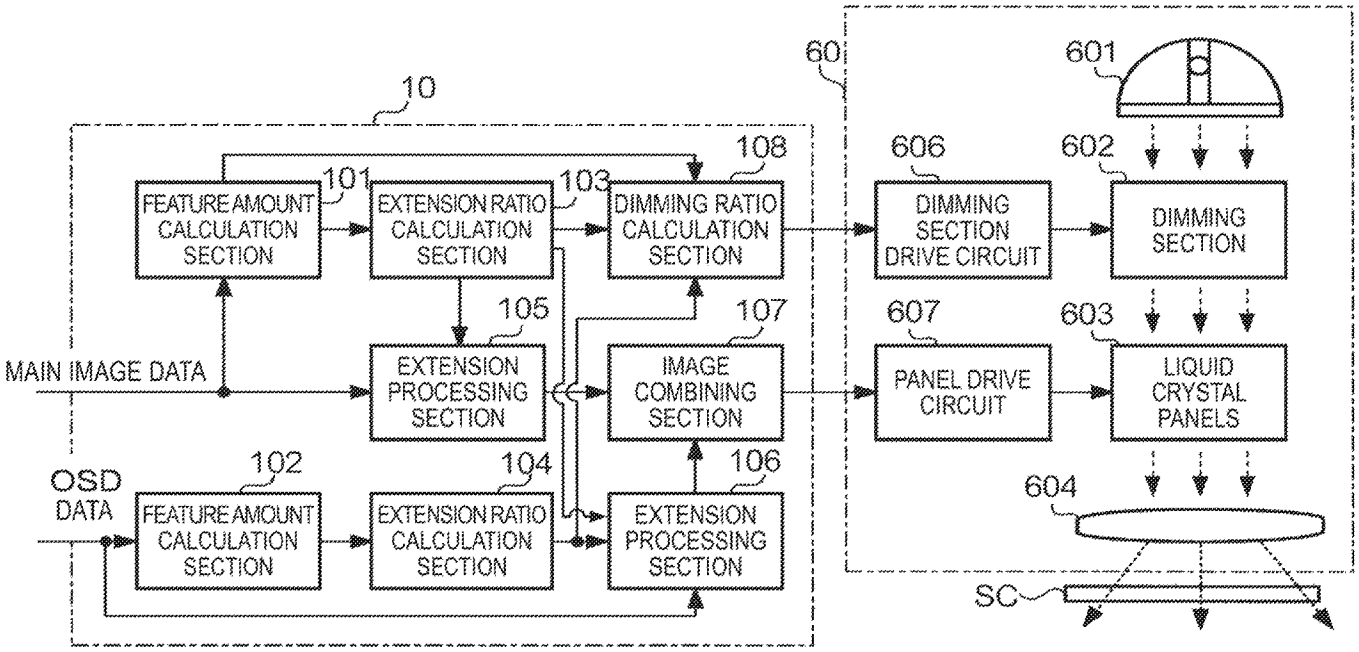
FIG. 3 is a block diagram mainly showing a part of a function realized by a CPU.

FIG. 3 is a block diagram mainly showing a part of a function realized by the CPU 10. The CPU 10 includes feature amount calculation sections 101, 102, extension ratio calculation sections 103, 104, extension processing sections 105, 106, an image combining section 107, and a dimming ratio calculation section 108 as functional elements. The feature amount calculation section 101 calculates feature amounts based on the luminance of the main image data. The feature amounts each denote a value representing a feature of the distribution of the luminance of the image data. In this example, the feature amounts correspond to an average value (hereinafter referred to as an "APL (Average Picture Level) value") of the luminance included in the image data, and the maximum value (hereinafter referred to as a "WP (White Peak) value") of the luminance included in the image data. The image data includes the grayscale values of the respective color components (e.g., the three primary colors of RGB), and the luminance is calculated based on the grayscale values. The feature amount calculation section 102 calculates the feature amounts based on the luminance of the OSD data. The extension ratio calculation section 103 (an example of a first extension ratio calculation section) calculates a first extension ratio based on the feature amount calculated by the feature amount calculation section 101. The extension ratio calculation section 104 (an example of a second extension ratio calculation section) calculates a second extension ratio based on the feature amount calculated by the feature amount calculation section 102. The extension processing section 105 (an example of a first extension section) corrects the grayscale value included in the main image data based on the first extension ratio calculated by the extension ratio calculation section 103 to extend the range (hereinafter referred to as a "luminance range") of the distribution of the luminance of the main image data. The extension processing section 106 (an example of a second extension section) corrects the grayscale value included in the OSD data based on selected one of the first extension ratio and the second extension ratio calculated by the extension ratio calculation section 104, and then extends the luminance range of the OSD data. The image combining section 107 (an example of a combination section) generates composite image data obtained by combining the main image data having the grayscale value corrected by the extension processing section 105 and the OSD data having the grayscale value corrected by the extension processing section 106 with each other. The dimming ratio calculation section 108 calculates a dimming ratio based on selected one of the first extension ratio and the second extension ratio.

Figure 4:
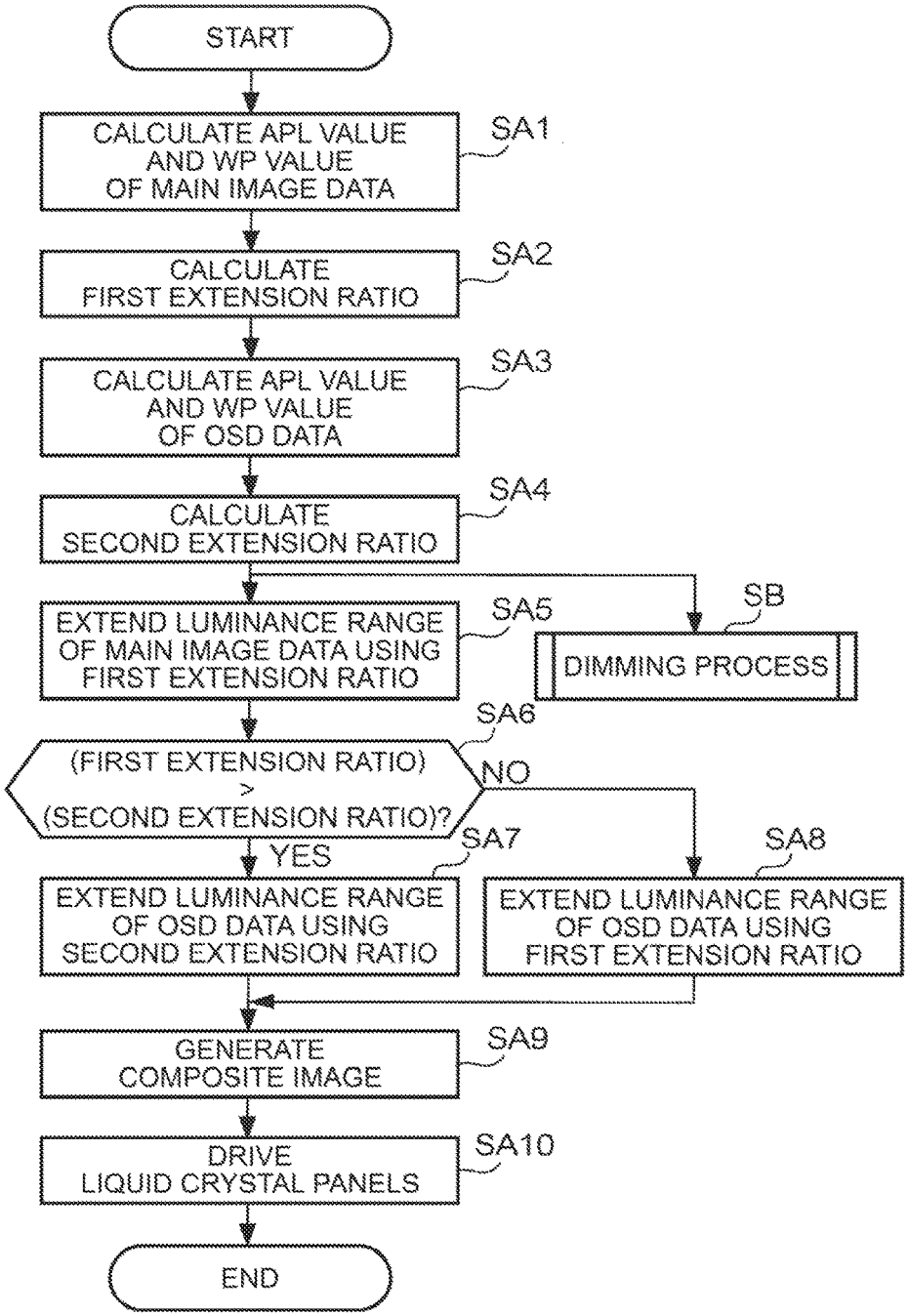
FIG. 4 is a flowchart showing a luminance extension process.

FIG. 4 is a flowchart showing a process (hereinafter referred to as a "luminance extension process") of the projector 1 for extending the luminance range. The following process is triggered by, for example, the fact that the user operates the controller RC to input an instruction for projecting the OSD to the screen SC. When the instruction for projecting the OSD is input, the CPU 10 reads out the control program 20A from the ROM 20 to execute the following process. In FIG. 4, the luminance extension process is performed frame by frame on the main image and the OSD.

In the step SA1, the CPU 10 calculates the APL value and the WP value of the main image data. Specifically, the CPU 10 reads out the main image data from the frame memory 30*a*, and then calculates the APL value and the WP value using the following process. Firstly, the CPU 10 calculates the luminance Y1 of each of the pixels based on the grayscale value included in the main image data. The luminance Y1 is calculated by, for example, Formula (1) below.

$$Y1=0.299R+0.587G+0.144B \quad (1)$$

(Y1: the luminance of a certain pixel; R, G, and B: the respective grayscale values of R, G, and B components of that pixel)

Subsequently, the CPU 10 divides the main image into a predetermined number (e.g., 48×64) of small areas Di. In this example, each of the small areas Di includes 256 (16×16) pixels. The CPU 10 then calculates the average value (hereinafter referred to as "average luminance Y2*i*") of the luminance Y1 of the 256 pixels for each of the small areas Di. Then, the CPU 10 calculates an average value of the plurality of average luminance values Y2*i* as the APL value. Further, the CPU 10 calculates the maximum value of the plurality of average luminance values Y2*i* as the value. The CPU 10 stores the APL value and the WP value thus calculated in the RAM 30.

Figure 5:
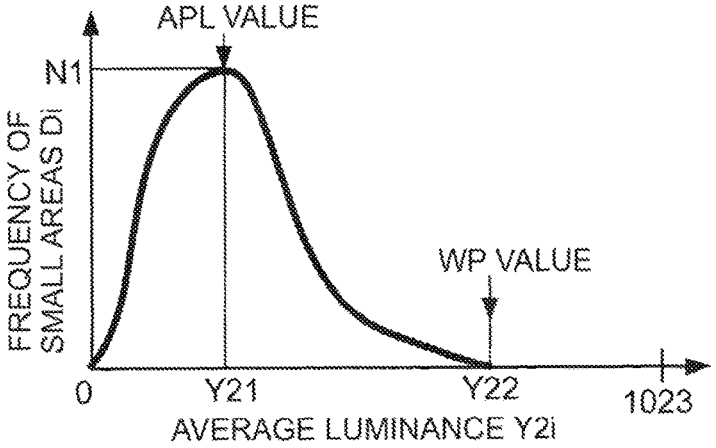
FIG. 5 is a histogram of the luminance related to main image data.

FIG. 5 is a diagram showing a histogram of the luminance related to the main image data as an example. FIG. 5 shows the histogram of the average luminance Y2*i*. In FIG. 5, the horizontal axis represents the average luminance Y2*i*. In this example, the average luminance Y2*i* is expressed in 10 bits. The vertical axis represents the frequency of the small areas Di. In the example shown in FIG. 5, the APL value is Y21, and the WP value is Y22. Further, the maximum value of the frequency of the small areas Di is N1. As is obvious from the definition, the APL value takes a value equal to or smaller than the WP value.

FIG. 4 is referred to again. In the step SA2, the CPU 10 calculates the first extension ratio based on the APL value and the WP value of the main image data. The first extension ratio is a value representing a magnification ratio for extending the luminance range of the main image data. The CPU 10 calculates the first extension ratio based on the APL value and the WP value of the main image data read out from the RAM 30. The calculation of the first extension ratio is performed by referring to an extension ratio look-up table (hereinafter referred to as an "LUT"). The LUT is stored in the ROM 20. The CPU 10 stores the first extension ratio thus calculated in the RAM 30.

Figure 6:
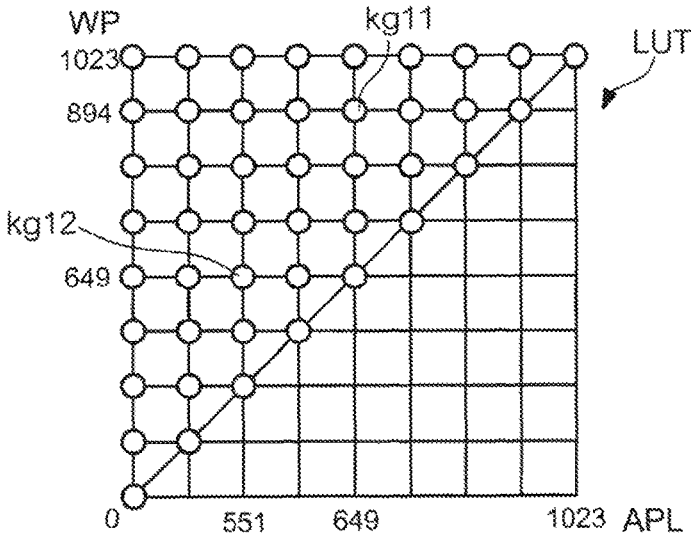
FIG. 6 is a diagram showing a model of a look-up table.

FIG. 6 is a diagram showing a model of the LUT. In the model shown in FIG. 6, the LUT is shown in a grid-like pattern, wherein the horizontal axis represents the APL value, and the vertical axis represents the WP value. It should be noted that the APL value and the WP value shown in FIG. 6 are illustrative only, and any values different from those shown in FIG. 6 can be recorded on the LUT. The first extension ratio kg1 (≥1) is stored in each of the places (hereinafter referred to as grid points) where the grid lines intersect with each other. The first extension ratio kg1 is calculated based on the combination of the APL value and the WP value. For example, in the case in which the APL value is 649 and the WP value is 894, the first extension ratio kg1 is kg11, and in the case in which the APL value is 551, and the WP value is 649, the first extension ratio kg1 is kg12. In the case in which the combination of the APL value and the WP value does not exist on the grid point, the first extension ratio kg1 is calculated using an interpolation method. Specifically, the first extension ratio kg1 in the combination of the APL value and the WP value is interpolated based on the first extension ratio kg1 represented by each of the grid points located in the periphery of the position indicated by that combination. It should be noted that since the APL value is equal to or smaller than WP value as described above, the first extension ratio kg1 is not recorded in the lower right half of the LUT. The CPU 10 stores the first extension ratio kg1 thus calculated in the RAM 30.

FIG. 4 is referred to again. In the step SA3, the CPU 10 calculates the APL value and the WP value of the OSD data. Specifically, the CPU 10 reads out the OSD data from the frame memory 30*b*, and then calculates the APL value and the WP value using substantially the same process as in the step SA1. It should be noted that the number of the small areas Di, or the number of the pixels included in the small area Di is not limited to the case of being the same as in the step SA1. The CPU 10 stores the APL value and the WP value thus calculated in the RAM 30.

Figure 7:
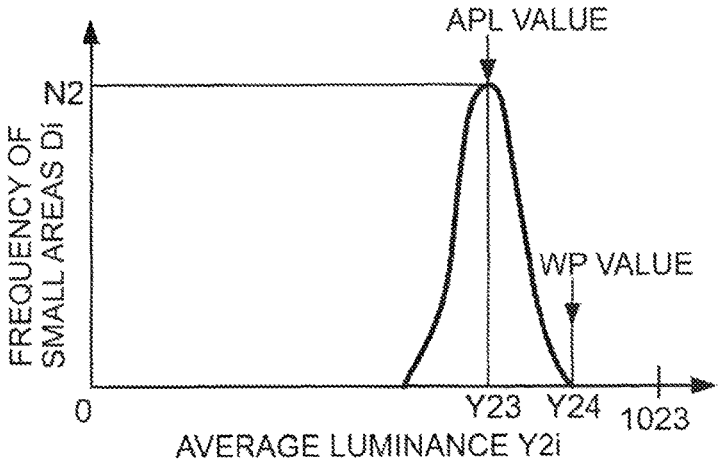
FIG. 7 is a histogram of the luminance related to OSD data.

FIG. 7 is a diagram shooing a histogram of the luminance related to the OSD data as an example. In this example, the APL value of the OSD data is Y23 (>Y21), and the WP value is Y24 (>Y22). Further, the maximum value of the frequency of the small areas Di is N2. The OSD represented by the OSD data shown in FIG. 7 is an image brighter than the main image represented by the main image data shown in FIG. 5. In such a case, if the luminance range of the OSD data is extended using the first extension ratio kg1, it results that the luminance range is excessively extended, and the highlight detail loss (the state of a plurality of pixels different in luminance from each other, in which the luminance is saturated so that the difference in luminance is not perceived by the user) becomes easy to occur in the OSD. The projector 1 prevents the highlight detail loss of the OSD due to the luminance extension process.

FIG. 4 is referred to again. In the step SA4, the CPU 10 calculates the second extension ratio based on the APL value and the WP value of the OSD data. The second extension ratio is a value representing an upper limit of a magnification ratio for extending the luminance range of the OSD data.

The CPU 10 calculates the second extension ratio kg2 (≥1) based on the APL value and the WP value of the OSD data read out from the RAM 30 using substantially the same process as in the step SA2. In this example, the second extension ratio kg1 is calculated using the LUT having been referred to for calculating the first extension ratio kg1. The CPU 10 stores the second extension ratio kg1 thus calculated in the RAM 30. In the step SA4, when the second extension ratio kg1 is calculated, the process (hereinafter referred to as a "dimming process") for controlling the light applied from the light source 601 is started. The dimming process is performed in parallel to the luminance extension process shown in FIG. 4. The details of the dimming process will be described later.

In the step SA5, the CPU 10 extends the luminance range of the main image data using the first extension ratio kg1. The CPU 10 reads out the main image data from the frame memory 30*a*, and the first extension ratio kg1 from she RAM 30, respectively, and then extends the luminance range using Formula (2) below.

$$Rnew1=Rold1\times kg1$$

$$Gnew1=Gold1\times kg1$$

$$Bnew1=Bold1\times kg1 \quad (2)$$

(Rnew1, Gnew1, and Bnew1: the respective grayscale values of the R, G, and B components of a certain pixel of the main image data, on which the luminance extension processing has been performed; Rold1, Gold1, and Bold1: the respective grayscale values of the R, G, and B component of that pixel on which the luminance extension has not been performed)

The CPU 10 writes the main image data with the luminance range extended in the frame memory 30*a*. When the luminance range is extended, the contrast of the image is enhanced.

Figure 8:
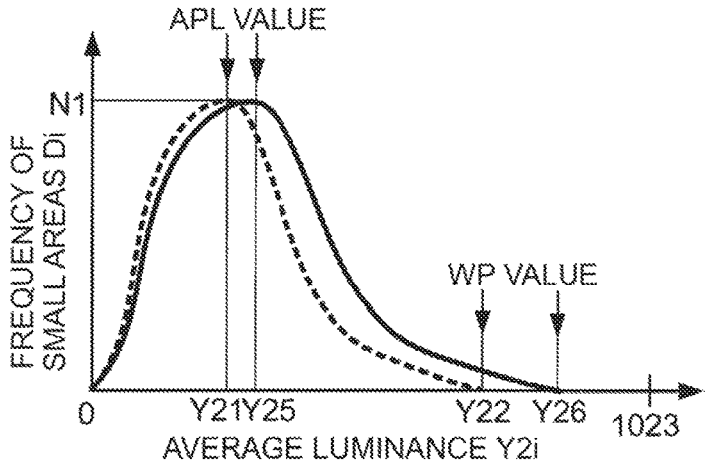
FIG. 8 is a diagram showing histograms of the luminance of certain main image data before and after the luminance extension process.

FIG. 8 is a diagram showing the change in the histogram of the luminance before and after the luminance extension process with respect to the main image data as an example. FIG. 8 shows the histogram of the average luminance Y2*i* similarly to FIG. 5. In FIG. 8, the solid line represents the histogram of the main image data on which the luminance extension process has been performed, and the dotted line represents the histogram of the main image data on which the luminance extension process has not been performed. In FIG. 8, the APL value of the main image data on which the luminance extension process has been performed is Y25 (>Y21), and the WP value is Y26 (>Y22). As shown in FIG. 8, when the luminance extension process is performed on the image data, the APL value and the WP value become greater compared to those before the luminance extension process.

FIG. 4 is referred to again. In the step SA6, the CPU 10 determines whether or not the first extension ratio kg1 is higher than the second extension ratio kg2. Specifically, the CPU 10 reads out the first extension ratio kg1 and the second extension ratio kg1 from the RAM 30, and then compares these values with each other. In the case in which it is determined that the first extension ratio kg1 is higher than the second extension ratio kg1 (YES in the step SA6), the CPU 10 makes a transition of the process to the step SA7. In the case in which it is determined that the first extension ratio kg1 is not higher than the second extension ratio kg1 (NO in the step SA6), the CPU 10 makes a transition of the process to the step SA8.

It the step SA7, the CPU 10 extends the luminance range of the OSD data using the second extension ratio kg2. The CPU 10 reads out the OSD data from the frame memory 30*b*, and the second extension ratio kg1 from the RAM 30, respectively, and then extends the luminance range using Formula (3) below.

$$Rnew2=Rold2\times kg2$$

$$Gnew2=Gold2\times kg2$$

$$Bnew2=Bold2\times kg2 \quad (3)$$

(Rnew2, Gnew2, and Bnew2: the respective grayscale values of the R, G, and B components of a certain pixel of the OSD data, on which the luminance extension processing has been performed; Rold2, Gold2, and Bold2: the respective grayscale values of the R, G, and B component of that pixel on which the luminance extension has not been performed)

The CPU 10 writes the OSD data with the luminance range extended in the frame memory 30*b*. in the step SA8, the CPU 10 extends the luminance range of the OSD data using the first extension ratio kg1. The CPU 10 reads out the OSD data from the frame memory 30*b*, and the first extension ratio kg1 from the RAM 30, respectively, and then extends the luminance range using Formula (2) described above.

Figure 9:
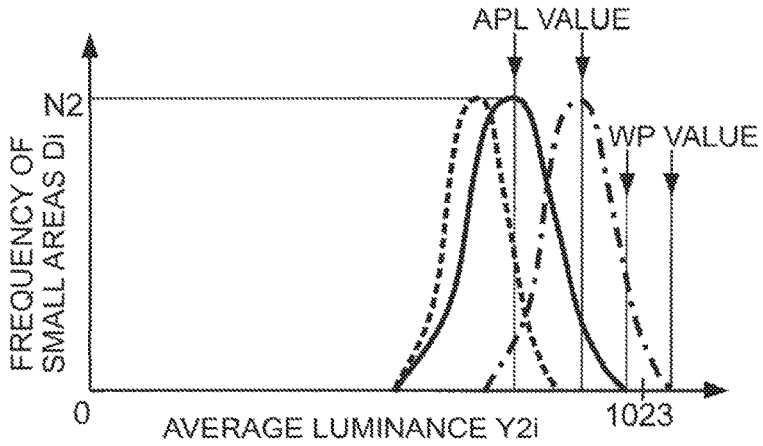
FIG. 9 is a diagram showing histograms of the luminance of certain OSD data before and after the luminance extension process.

FIG. 9 is a diagram showing the change in the histogram of the luminance before and after the luminance extension process with respect to the OSD data as an example. In FIG. 9, the solid line represents the histogram in the case of performing the luminance extension process using the second extension ratio kg2. Further, the dashed-dotted line represents the histogram in the case of performing the luminance extension process using the first extension ratio kg1. The dotted line represents the histogram before the luminance extension process. In this example, kg1>kg1 is true. Therefore, as a result of the determination in the step SA6, the process proceeds to the step SA7, and the luminance range is extended using the second extension ratio kg2. In this case, since the OSD data is extended using the second extension ratio kg2, which has been calculated using the OSD data, the highlight detail loss is prevented from occurring in the OSD. It should be noted that in the case in which the first extension ratio kg1 does not exceed the second, extension ratio kg2, the luminance range of each of the main image data and the OSD data is extended using the first extension ratio kg1.

FIG. 4 is referred to again. In the step SA9, the CPU 10 generates the composite image obtained by superimposing the OSD on the main image. Specifically, the CPU 10 combines the main image data written in the frame memory 30*a* and the OSD data written in the frame memory 30*b* with each other to thereby generate the composite image, and then writes the composite image in the frame memory 30*c* as the composite image data. In the step SA10, the CPU 10 drives the liquid crystal panels 603 in accordance with the composite image data. Specifically, the CPU 10 reads out the composite image data from the frame memory 30*c*, and then outputs the composite image data to the panel drive circuit 607.

Figure 10:
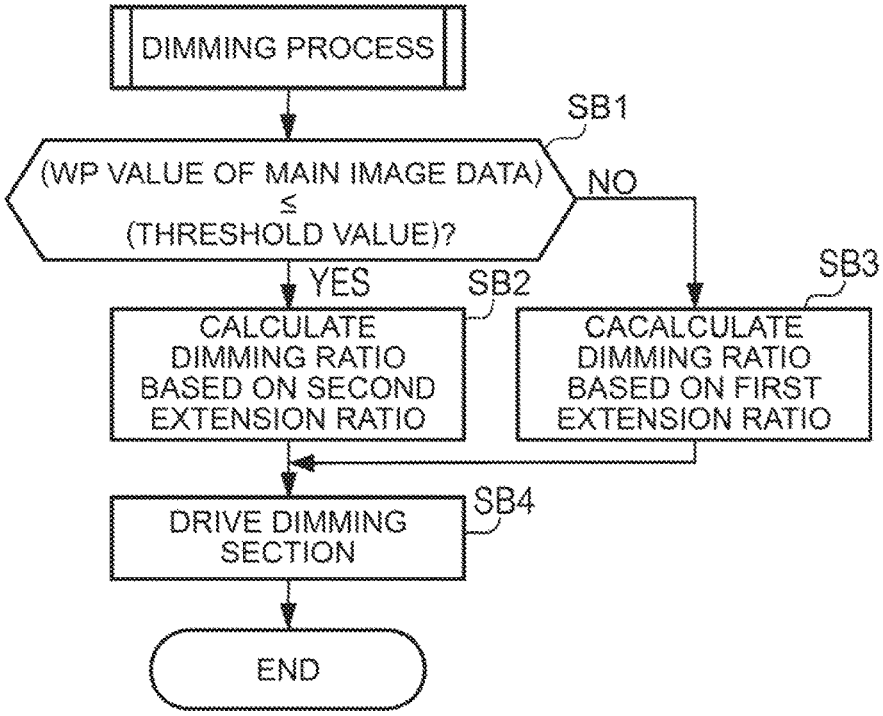
FIG. 10 is a flowchart showing a dimming process.

FIG. 10 is a flowchart showing the dimming process. In the step SB1, the CPU 10 determines whether or not the WP value of the main image data is equal to or lower than a predetermined threshold value. The threshold value is a value to be a criterion of determination on whether or not the main image is an image darker than a predetermined brightness. The threshold value is stored in advance in the ROM 20. The CPU 10 reads out the WP value of the main image data from the RAM 30, and the threshold value from the ROM 20, respectively, and then compares these values with each other. In the case in which it is determined that the WP value is equal to or lower than the threshold value (YES in the step SB1), the CPU 10 makes a transition of the process to the step SB2. In the case in which it is determined that the WP value fails to be equal to or lower than the threshold value (NO in the step SB1), the CPU 10 makes a transition of the process to the step SB3.

In the step SB2, the CPU 10 calculates a dimming ratio ka based on the second extension ratio kg2. The dimming ratio denotes a value representing the proportion of the light transmitted by the dimming section 602. The CPU 10 reads out the second extension ratio kg1 from the RAM 30 to calculate the dimming ratio ka using Formula (4) below.

$$ka=kg2^{-\gamma} \tag{4}$$

Here, γ denotes the gamma value of the liquid crystal panels, and γ=2.2 is assumed for example.

The CPU 10 stores the dimming ratio ka thus calculated in the RAM 30.

In the step SB3, the CPU 10 calculates the dimming ratio ka based on the first extension ratio kg1. The CPU 10 reads out the first extension ratio kg1 from the RAM 30 to calculate the dimming ratio ka using Formula (5) below.

$$ka=kg1^{-\gamma} \tag{5}$$

In the step SB4, the CPU 10 drives the dimming section 602 in accordance with the dimming ratio ka. Specifically, the CPU 10 reads out the dimming ratio ka from the RAM 30, and then outputs a signal representing the dimming ratio ka to the dimming section drive circuit 606. When the dimming section 602 is driven in accordance with the dimming ratio ka calculated using Formula (4), even in the case in which the main image is a dark image, the OSD projected on the screen SC is inhibited from becoming so dark that the OSD is not perceived by the user. Further, when the dimming section 602 is driven in accordance with the dimming ratio ka calculated using Formula (5), the brightness of the main image displayed on the screen SC after performing the luminance extension process and the dimming process becomes the same as in the case in which the luminance extension process and the dimming process are not performed.

MODIFIED EXAMPLES

The invention is not limited to the embodiments described above, but can be put into practice with a variety of modifications. Hereinafter, some modified examples will be explained. It is also possible to use two or more of the modified examples explained hereinafter in combination.

1. Modified Example 1

In the above description of the embodiment, the example in which the second image data is the OSD data is explained. In this respect, the second image data can also be data representing any image providing the image is projected so as to be superimposed on the main image.

2. Modified Example 2

The feature amounts are not limited to the APL value and the WP value. For example, the lowest value of the luminance included in the image data can also be used as the feature amount in addition to the APL value and the WP value. In another example, it is also possible to use only the APL value as the feature amount.

3. Modified Example 3

The method or calculating the APL value and the WP value of the image data is not limited to the method in the description of the embodiment. For example, the APL value and the WP value can also be calculated without dividing the image into the small areas Di. Further, although the WP value is calculated by obtaining the maximum value of the average luminance values Y2*i* in the above description of the embodiment, the WP value can also be calculated by obtaining the maximum value of the luminance Y1. In another example, the APL value and the WP value can be calculated in a part of the area of the image.

4. Modified Example 4

The frequency of the calculation of the APL value and the WP value of the main image data or the OSD data is not limited to "every frame." It is also possible for the CPU 10 to calculate the APL value and the WP value of the main image data or the OSD data, for example, every several frames or every predetermined time periods. In another example, if is also possible for the CPU 10 to calculate the APL value and the WP value every time the scene represented by the main image or the OSD changes. On this occasion, when the APL value and the WP value of the main image data or the OSD data are newly calculated, the first extension ratio or the second extension ratio is changed based on these values.

5. Modified Example 5

The LUT used for calculating the second extension ratio kg2 in the step SA4 can also be an LUT different from the LUT having been referred to for calculating the first extension ratio kg1. Further, the LUT can also store the coefficient used for calculating the extension ratio.

6. Modified Example 6

Although in the above description of the embodiment, the dimming ratio ka is calculated based on selected one of the first extension ratio kg1 and the second extension ratio kg2, the dimming ratio ka can also be calculated based on the first extension ratio kg1. In this case, the process of the steps SB1 and SB2 is omitted in the dimming process. In the case in which the dimming ratio ka is calculated based on the first extension ratio kg1, the dimming section 602 is driven at the dimming ratio suitable for the grayscale value of the main image data.

7. Modified Example 7

The dimming ratio ka is not limited to the case of being calculated based on the first extension ratio kg1 or the second extension ratio kg2. The dimming ratio ka can also be calculated based on, for example, the feature amount of the main image data or the OSD data. On this occasion, in the step SB2, the CPU 10 calculates the dimming ratio ka based on the APL value and the WP value of the OSD data. Further, in the step SB3, the CPU 10 calculates the dimming ratio ka based on the APL value and the WP value of the main image data.

Further, the method of calculating the first extension ratio kg1 and the second extension ratio kg1 is not limited to the method based on the feature amount of the main image data or the OSD data. For example, it is also possible that two dimming ratios ka are calculated based on the feature amounts of the main image data and the OSD data, and the first extension ratio kg1 and the second extension ratio kg1 are respectively calculated based on the two dimming ratios ka. On this occasion, in the dimming process, the dimming ratio ka based on the APL value and the WP value of the main image data and the dimming ratio ka based on the APL value and the WP value of the OSD data are respectively calculated, and the dimming section 602 in driven in accordance with selected one of the two dimming ratios ka. More specifically, in the case in which the WP value of the main image data is equal to or lower than the threshold value, the dimming section 602 is driven in accordance with the dimming ratio ka based on the APL value and the WP value of the OSD data, and in the case in which the WP value of the main image data is not equal to or lower than the threshold value, the dimming section 602 is driven in accordance with the dimming ratio ka based on the APL value and the WP value of the main image data. Further, on this occasion, in the luminance extension process shown in FIG. 4, the processes in the step SA2, and the step SA4 and the following steps are performed after the two dimming ratios ka are calculated in the dimming process.

8. Modified Example 8

The image data can include an alpha value representing the permeation rate of each of the pixels in addition to the grayscale value. In this case, the calculation corresponding to Formula (2) or Formula (3) is not performed on the alpha value.

9. Other Modified Examples

Formulas (1) through (5) are illustrative only, and the luminance Y1, the first extension ratio kg1, the second extension ratio kg2, or the dimming ratio ka can be calculated, or the luminance range can be extended using formulas different from these formulas.

The internal configuration of the projector 1 is not limited to the configuration explained with reference to FIG. 1. The projector 1 can have any internal configuration providing the process of each of the steps shown in FIGS. 4 and 10 can be executed.

What is claimed is:

1. An image processing device comprising:

a processor configured to:

calculate a first extension ratio based on a first grayscale value included in main image data containing a main image, the first extension ratio representing an amount of extension of a range of luminance in the main image;

calculate a second extension ratio based on a second grayscale value included in On Screen Display (OSD) image data containing an OSD image, the second extension ratio representing an amount of extension of a range of luminance in the OSD image;

correct the first grayscale value based on the first extension ratio to extend a range of a distribution of luminance of the main image data;

correct the second grayscale value to extend a range of a distribution of luminance of the OSD image data, based on:

the first extension ratio when the first extension ratio is equal to or lower than the second extension ratio; or the second extension ratio when the first extension ratio is higher than the second extension ratio;

generate composite image data obtained by combining the main image data having the corrected first grayscale value and the OSD image data having the corrected second grayscale value with each other; and calculate a dimming ratio based on selected one of the first extension ratio and the second extension ratio;

a dimmer adapted to dim a light source; and a driver adapted to drive the dimmer based on the dimming ratio.

2. The image processing device according to claim 1, wherein the processor is further configured to:

calculate the dimming ratio based on the second extension ratio in a case in which a maximum value of the luminance calculated from the first grayscale value is one of equal to or lower than a threshold value.

3. The image processing device according to claim 1, wherein the processor is further configured to:

calculate the dimming ratio based on the first extension ratio in a case in which a maximum value of the luminance calculated from the first grayscale value is higher than a threshold value.

4. The image processing device according to claim 1, wherein the processor is further configured to:

calculate the first extension ratio based on a maximum value and an average value of the luminance calculated from the first grayscale value, and calculate the second extension ratio based on a maximum value and an average value of the luminance calculated from the second grayscale value.

5. The image processing device according to claim 1, wherein the OSD image includes a black bar.

6. The image processing device according to claim 5, wherein the OSD image includes a subtitle.

7. The image processing device according to claim 5, wherein the OSD image includes an aspect ratio.

8. A projector comprising:

a processor configured to:

calculate a first extension ratio based on a first grayscale value included in main image data containing a main image, the first extension ratio representing an amount of extension of a range of luminance in the main image;

calculate a second extension ratio based on a second grayscale value included in On Screen Display (OSD) image data containing an OSD image, the second extension ratio representing an amount of extension of a range of luminance in the OSD image;

correct the first grayscale value based on the first extension ratio to extend a range of a distribution of luminance of the main image data;

correct the second grayscale value to extend a range of a distribution of luminance of the OSD image data, based on:

the first extension ratio when the first extension ratio is equal to or lower than the second extension ratio; or the second extension ratio when the first extension ratio is higher than the second extension ratio;

generate composite image data obtained by combining the main image data having the corrected first grayscale value and the OSD image data having the corrected second grayscale value with each other; and calculate a dimming ratio based on selected one of the first extension ratio and the second extension ratio;

a dimmer adapted to dim a light source;

a driver adapted to drive the dimmer based on the dimming ratio; and a light modulator adapted to modulate incident light based on the composite image data.

9. The projector according to claim 8, wherein the processor is further configured to:

calculate the dimming ratio based on the second extension ratio in a case in which a maximum value of the luminance calculated from the first grayscale value is one of equal to or lower than a threshold value.

10. The projector according to claim 8, wherein the processor is further configured to:

calculate the dimming ratio based on the first extension ratio in a case in which a maximum value of the luminance calculated from the first grayscale value is higher than a threshold value.

11. The projector according to claim 8, wherein the processor is further configured to:

calculate the first extension ratio based on a maximum value and an average value of the luminance calculated from the first grayscale value, and calculate the second extension ratio based on a maximum value and an average value of the luminance calculated from the second grayscale value.

12. A method of displaying an image comprising:

calculating, using a processor, a first extension ratio based on a first grayscale value included in main image data containing a main image, the first extension ratio representing an amount of extension of a range of luminance in the main image;

calculating, using the processor, a second extension ratio based on a second grayscale value included in On Screen Display (OSD) image data containing an OSD image, the second extension ratio representing an amount of extension of a range of luminance in the OSD image;

correcting, using the processor, the first grayscale value based on the first extension ratio to extend a range of a distribution of luminance of the main image data;

correcting, using the processor, the second grayscale value to extend a range of a distribution of luminance of the OSD image data, based on:

the first extension ratio when the first extension ratio is equal to or lower than the second extension ratio; or the second extension ratio when the first extension ratio is higher than the second extension ratio;

generating, using the processor, composite image data obtained by combining the main image data having the corrected first grayscale value and the OSD image data having the corrected second grayscale value with each other;

calculating, using the processor, a dimming ratio based on selected one of the first extension ratio and the second extension ratio;

driving, using a driver, a dimmer adapted to dim a light source, based on the dimming ratio; and displaying the composite image data as a composite image.

* * * * *